United States Patent [19]

Roos et al.

[11] 4,422,921

[45] Dec. 27, 1983

[54] BIPOLAR ELECTRODES WITH GRAPHITE AS THE CARRIER AND THEIR PRODUCTION

[75] Inventors: Hans Roos, Bad Durkheim; Hugo Boehn, Ludwigshafen; Knut Bittler, Speyer; Dieter Schlaefer, Ludwigshafen, all of Fed. Rep. of Germany

[73] Assignee: BASF Aktiengesellschaft, Fed. Rep. of Germany

[21] Appl. No.: 408,600

[22] Filed: Aug. 16, 1982

[30] Foreign Application Priority Data

Aug. 19, 1981 [DE] Fed. Rep. of Germany ..... 3132753

[51] Int. Cl.[3] ..... C25B 11/00

[52] U.S. Cl. ..... 204/290 R; 427/34

[58] Field of Search ..... 204/254, 290 R, 291, 204/294; 427/34

[56] References Cited

U.S. PATENT DOCUMENTS

| | | | |
|---|---|---|---|
| 3,597,337 | 8/1971 | Jaksic | 204/294 |
| 3,752,757 | 8/1973 | Stephenson | 204/254 |
| 4,308,115 | 12/1981 | Foster | 204/294 |

*Primary Examiner*—John F. Niebling

*Attorney, Agent, or Firm*—Keil & Witherspoon

[57] ABSTRACT

Bipolar electrodes with graphite as the carrier have a layer of chromium trioxide not less than 10 μm thick on both the anode face and the cathode face.

The electrodes are produced by plasma-spraying chromium trioxide powder onto a graphite layer, and can be used as bipolar electrodes in alkali metal chloride electrolysis cells.

2 Claims, No Drawings

BIPOLAR ELECTRODES WITH GRAPHITE AS THE CARRIER AND THEIR PRODUCTION

In bipolar cells, each electrode is wired so that, without a current connection outside the cell, one part operates as the anode and the other as the cathode. The conventional arrangement is for one surface to serve as the anode and the opposite surface to serve as the cathode.

The current enters the cell on one face via an anode, and flows within the first electrolyte chamber to the counter-electrode, which acts as the cathode, and then through this electrode to the opposite face, which assumes the function of the anode. After the current has flowed through all the electrodes and electrolyte chambers, it leaves the cell at the other end, via the cathode. In the case of electrolytes of good conductivity, the electrolyte chambers must be completely separated from one another so that the current flows from one chamber to the next only via the electrodes and not via other shunt circuits.

Compared with monopolar cells, bipolar cells have the great advantage that the bus-bar connections with their contacts between the individual cells, and hence also the cost of these bus-bars and the current losses which continuously occur therein during operation are eliminated. Cell units with relatively high operating voltages and hence high capacities can be produced by joining together a number of individual chambers, and thus dividing up the production capacity into units operating with high voltages but relatively low current intensities. Other advantages are that, in relation to the output, the space requirement is low and a smaller amount of electrolyte is required, which is particularly useful in the case of organic electrosyntheses.

The use of bipolar cells is ruled out if the electrode material is not sufficiently resistant towards the electrolyte or the electrolysis products so that the cells must be switched off more frequently for the electrodes to be changed. Removal of the spent electrodes and insertion of new electrodes is time-consuming because of the relatively complicated construction of such cells.

Since the bipolar electrodes in such cells are exposed to different stresses on the anode face and cathode face as a result of the different electrolytes and the different electrolysis products, the two faces of the electrode must as a rule be made of different materials, so that a two-layered electrode results, the layers of which are held together by expensive mechanical connections. Such bipolar electrode constructions are disclosed in, for example, German Pat. No. 2,328,769 and German Laid-Open Applications DOS No. 2,262,173 and DOS No. 2,328,770. Such connecting points are in turn highly susceptible to corrosive attack, and must therefore be protected from corrosion by particularly expensive techniques. Thus, for example, the bipolar electrodes disclosed in the above German Patent consist of a valve metal on the anode face, while the cathode face is made of iron or an iron alloy.

Graphite is frequently employed as the anode material in cells operated as monopolar cells, for example those for the electrolysis of alkali metal chlorides. This material cannot be used as the electrode material in cells operated as bipolar cells, since it burns away on the anode face as a result of the ever-present evolution of oxygen, $CO_2$ being formed. As the same time, graphite has a relatively open structure with many pores, which has the advantage of giving the graphite a large surface area, but the disadvantage that the electrolysis process continues in these pores in a brine with a depleted NaCl content, which intensifies the evolution of oxygen. In order therefore to provide better protection for graphite against oxidation, it is impregnated with linseed oil, tarpitch, chlorinated naphthalenes, synthetic waxes or the like (cf. Alfred Schmidt, Angewandte Elektrochemie, Verlag Chemie 1976, page 131).

For these reasons, graphite electrodes have not yet been used as bipolar electrodes, at least in industry, although graphite would be a useful material for such electrodes because of its reasonable price and its good electrical conductivity.

It is an object of the present invention to provide bipolar electrodes based on graphite which on the one hand have a high deposition voltage for oxygen and thus do not wear away rapidly on the anode face, and which on the other hand are resistant towards the electrolytes and electrolysis products and have a long life.

We have found that this object is achieved with a bipolar graphite electrode which has a layer of $Cr_2O_3$ not less than 10 μm thick on both the anode face and the cathode face.

The electrodes according to the invention are advantageously produced with the aid of a thermal spraying process, preferably the plasma spraying process. It is also possible to produce these active layers by suitable application of a chromium-containing suspension or solution and subsequent baking.

In the plasma spraying process, the $Cr_2O_3$ should advantageously have a particle size of from 10 to 200 μm, preferably of $<150$ μm. The coating operation can be carried out with a conventional plasma spraying apparatus, in which argon, helium and nitrogen, alone or as a mixture with hydrogen, can be used as the carrier gas and the plasma torch is operated at an energy of from 20 to 60 kw. The distance between the plasma flame and the substrate to be coated is advantageously from 9 to 14 cm. The plasma flame is moved slowly backwards and forwards in front of the substrate to be coated, until the sprayed coating has reached the desired thickness of $>10$ μm. The $Cr_2O_3$ layer is advantageously from 10 to 30 μm thick. Although thicker layers are no disadvantage industrially, they are inexpedient for economic reasons.

When used as anodes in the electrolysis of an alkali metal chloride at a current density of 0.15 $kA/m^2$, the electrodes according to the invention have a chlorine deposition potential of 1,493 mv, based on the standard hydrogen electrode. However, even at the industrially interesting higher current densities of, for example, 1.5 $kA/m^2$, the chloride deposition potential is 1,813 mv and is of the same order of magnitude as that of graphite. A comparison with pure graphite as the electrode material shows, however, that the oxygen overvoltage of the electrodes according to the invention is substantially higher, ie. deposition of oxygen is also substantially suppressed in favor of deposition of chlorine.

Moreover, the electrodes according to the invention are very resistant to chemicals and have a high mechanical strength. The coating of $Cr_2O_3$ not only makes the surface of the graphite harder, but also, as a result of the substantially suppressed formation of oxygen, on the one hand because of the higher oxygen deposition potential and on the other hand because the surface is less porous, prevents the graphite from burning away.

Surprisingly, we have found that, in cases where hydrogen is formed as a reaction on the cathode face of the electrode, the $Cr_2O_3$ coating again provides substantial advantages, in addition to increasing stability to wear caused by gas bubbles. In particular, we have found that the hydrogen deposition potential on graphite is substantially lowered by applying a layer of $Cr_2O_3$, which, in addition to a welcome saving in energy, also provides the advantage that the current direction can be reversed when required (eg. cleaning runs) without adversely affecting the electrode material.

The other decisive advantage of the bipolar electrodes according to the invention which results from these properties is that the electrodes consist of a single carrier with the same electrochemically active layer on both the anode face and the cathode face. This eliminates the complicated multi-layered build-up of the electrode from various materials held together by expensive and corrosion-susceptible mechanical connections otherwise conventional with bipolar electrodes.

The electrodes according to the invention are suitable, for example, for electrolysis of alkali metal chlorides and of chlorate and hydrochloric acid. However, since the deposition of oxygen is of only minor importance in the electrolysis of hydrochloric acid, because of the acid pH, the advantage of the electrodes according to the invention is in this case restricted to the improved mechanical resistance to wear by gas bubbles and the lower deposition voltage for hydrogen on the cathode side.

EXAMPLE 1

(A) $Cr_2O_3$ powder having a particle size of $<30$ μm is applied to a sand-blasted graphite substrate with a surface area of about 20 $cm^2$ and a central electrical lead of graphite with the aid of a plasma torch at a spraying energy of 40.8 kw. Argon is used as the plasma carrier gas. After one spraying cycle/side at a distance of 12 cm, the coating is from about 15 to 20 μm thick.

The electrodes produced in this manner are subjected to a current voltage test under the operating conditions of alkali metal chloride electrolysis. The following deposition potentials are measured:

| Current density | 0.15 kA/$m^2$ | 1.5 kA/$m^2$ |
|---|---|---|
| Chlorine deposition potential | 1,493 mv | 1,813 mv |

(B) The deposition potentials of sand-blasted electrodes (as described in A) but without the coating of $Cr_2O_3$ are determined by a procedure similar to that in Example 1.

| Current density | 0.15 kA/$m^2$ | 1.5 kA/$m^2$ |
|---|---|---|
| Chlorine deposition potential | 1,493 mv | 1,808 mv |

(C) The graphite substrate is coated with $Cr_2O_3$ by a procedure similar to that described in Example 1, but the spraying cycle/face is continued only until the active layers are from about 6 to 8 μm thick. The following chlorine deposition potentials are measured:

| Current density | 0.15 kA/$m^2$ | 1.5 kA/$m^2$ |
|---|---|---|
| Chlorine deposition potential | 1,510 mv | 1,845 mv |

(D) The oxygen deposition potential of each of the electrodes described in A-C is determined in 1 N $H_2SO_4$ at a current density of 0.15 kA/$m^2$. The following values are obtained:

| | |
|---|---|
| Electrode from Example A | |
| (15–20 μm of $Cr_2O_3$) | 2,062 mv |
| Electrode from Example B | |
| Graphite (sand-blasted) | 1,891 mv |
| Electrode from Example C | |
| (~ 6–8 μm of $Cr_2O_3$) | 1,876 mv |

Examples A and B show that the chlorine deposition potentials of the electrodes according to the invention are in all cases only slightly different to those of conventional graphite electrodes. Example C shows that the chlorine deposition potential of an electrode covered with a $Cr_2O_3$ layer $<10$ μm thick is even higher than that of a pure graphite electrode.

In contrast, Example D shows the decisive advantage of the substantially increased oxygen deposition potential of an electrode according to the invention.

EXAMPLE 2

The graphite substrates coated with $Cr_2O_3$ as described in Example 1A are subjected to a current voltage test as cathodes in 5 N NaCl solution under the operating conditions of chlorate electrolysis. The following hydrogen deposition potentials are measured:

| Current density | | 0.15 kA/$m^2$ | 1.5 kA/$m^2$ |
|---|---|---|---|
| Hydrogen deposition potential | Electrode coated with $Cr_2O_3$ | 1,250 mv | 1,450 mv |
| | Graphite electrode | 1,380 mv | 1,720 mv |

EXAMPLE 3

The hydrogen deposition potentials are also determined under the conditions of alkali metal chloride electrolysis in a solution containing 10% by weight of NaOH and 16% by weight of NaCl by a procedure similar to that described in Example 2:

| Current density | | 0.15 kA/$m^2$ | 1.5 kA/$m^2$ |
|---|---|---|---|
| Hydrogen deposition potential | Electrode coated with $Cr_2O_3$ | 1,280 mv | 1,470 mv |
| | Graphite electrode | 1,380 mv | 1,750 mv |

Examples 2 and 3 show the advantages of the electrode according to the invention when it is connected as the cathode, these advantages being manifested, inter alia, in a lower hydrogen overvoltage than is the case with graphite.

We claim:

1. A bipolar electrode with graphite as the carrier, which has a chromium trioxide layer not less than 10 μm thick on both the anode face and the cathode face.

2. A bipolar electrode as claimed in claim 1, wherein the chromium trioxide layer is applied as a powder to the graphite carrier by means of a plasma spraying process.

* * * * *